United States Patent [19]

Dines et al.

[11] Patent Number: 4,648,049

[45] Date of Patent: Mar. 3, 1987

[54] RAPID GRAPHICS BIT MAPPING CIRCUIT AND METHOD

[75] Inventors: Steven Dines, San Jose; Adrian Sfarti; Andrew D. Daniel, both of Sunnyvale, all of Calif.

[73] Assignee: Advanced Micro Devices, Inc., Sunnyvale, Calif.

[21] Appl. No.: 607,995

[22] Filed: May 7, 1984

[51] Int. Cl.[4] ..... G09G 1/00

[52] U.S. Cl. ..... 364/521; 340/703; 340/723

[58] Field of Search ..... 364/518, 521; 340/703, 340/723, 799; 382/21

[56] References Cited

U.S. PATENT DOCUMENTS 4,500,875 2/1985 Schmitz ..... 340/723 X 4,520,356 5/1985 O'Keefe et al. ..... 340/703 X

*Primary Examiner*—Edward J. Wise

*Attorney, Agent, or Firm*—Patrick T. King; Gary Aka; J. Vincent Tortolano

[57] ABSTRACT

A circuit and method for a display controller especially adapted for display memories organized in arrays. The invention permits high speed modification of the contents of a display by generating the address signals of a selected linear pattern as the data block to be modified is retrieved from the display memory. For vectors, the addresses are generated in the same time as required for data block retrieval. The invention also permits calculation of the addresses of simple curves as the data block to be modified is retrieved, though calculation times typically are longer than for vectors. Modified Breshenham's algorithm is used for the address calculation.

23 Claims, 11 Drawing Figures

| $X_S \leq X_t$ | $Y_S \leq Y_t$ | $DX \geq DY$ | OCTANT | CERTAIN OFF 1 | POSSIB OFF 2 | (x,y) BLOCK STARTING CORNER | SUCCESSIVE STARTING CORNERS 8-PIXELS IN WHICH DIRECTION? |
|---|---|---|---|---|---|---|---|
| YES | NO | NO | 1 | -1 | +1 | 0,7 | -Y |
| NO | NO | NO | 2 | -1 | -1 | 7,7 | -Y |
| NO | NO | YES | 3 | -1 | -1 | 7,7 | -X |
| NO | YES | YES | 4 | -1 | +1 | 7,0 | -X |
| NO | YES | NO | 5 | +1 | -1 | 7,0 | +Y |
| YES | YES | NO | 6 | +1 | +1 | 0,0 | +Y |
| YES | YES | YES | 7 | +1 | +1 | 0,0 | +X |
| YES | NO | YES | 8 | +1 | -1 | 0,7 | +X |

RAPID GRAPHICS BIT MAPPING CIRCUIT AND METHOD

FIELD OF THE INVENTION

This invention relates to electronic display systems and, particularly, to a system for quickly modifying data in a display memory which is organized in arrays.

BACKGROUND OF THE INVENTION

A common configuration in display systems is shown in FIG. 1. The information to generate a display 12 is stored in a display memory 11. The display memory typically contains thousands of memory cells, each holding a single bit of information. Each bit (or group of bits in the case of color or shaded displays) of information corresponds to a small area, or pixel, in the display 12. Each memory location is used to store the intensity of the pixel. A bit represents or "maps" part of the display. The display 12 is typically a cathode ray tube unit in which the memory contents or some part thereof appear on the screen by scanning the memory.

Display memories are usually organized into strings of pixels or words, along a scan line. Still another way of organizing the display memory is by an array or block organization. In an array organization, the pixels are organized in n by n pixels so that images extending vertically, or perpendicular to scan lines, may also be modified. An explanation of array organization in a system for updating these arrays is found in an article, "A VLSI Architecture For Updating Raster Scan Displays" by Satish Gupta and Robert Sproull in *Computer Graphics,* Volume 15, No. 3, August 81, pages 71–79.

To change the contents of a display, no matter how arranged in the display memory, a display controller 10 receives part or all of the data in the display memory, or "reads" the information from the memory 11, modifies the data and then returns or "writes" the data back into the display memory 11. The display controller 10 makes its modification in response to instructions from a processor 13. The transfer of data from the display memory, the modification of the data, and the data transfer back into the display memory consumes valuable time. A requirement for many display systems is that the images on the display 12 be updated rapidly. This is particularly true in interactive displays in which a user viewing the display 12 modifies the images as they appear on the screen.

The present invention is specially adapted for display memories organized in arrays to permit a high speed modification of the data in the display memory.

SUMMARY OF THE INVENTION

The present invention provides for a circuit for modifying data in a display memory organized in arrays of data for bit-mapped graphics, comprising: first memory means for receiving and holding a first block of data from the display memory; a pattern generator, responsive to input signals, for generating signals corresponding to a selected linear pattern for the first block in approximately the same time as the first block is received by the first memory means; second memory means for holding the generated signals from the linear pattern generator; and logic means for combining the first block and the second memory means signals into a modified first block for return to the display memory.

This generation of points of the linear pattern occurs as the first block is transferred into the first memory means, permitting a data controller to operate at a much higher speed than found in the prior art.

Another aspect of the present invention comprises: a third memory means for receiving and holding a second block of data from the display memory, the third memory means receiving the second block as the first block and the second memory means signals are confirmed; and a fourth memory means for holding signals generated by said linear pattern generator, the generated signals corresponding to the selected vector pattern for the second block, the third memory means signals and the fourth memory means signals combined by the logic means into a modified second block for return to the display memory. By alternating the operation of the first and second memory means with the operation of the third and fourth memory means, the present invention allows even faster operation.

For the generation of address signals corresponding to a linear pattern, the linear pattern generator uses a modified form of Breshenham's algorithm. For vectors, the linear pattern generator produces signals corresponding to the selected vector in approximately the same time as the corresponding data block is transferred from the display memory. For vectors and simple curves, the last address of a set of points corresponding to the linear pattern in a block of data from the display memory leads to the first address of the set of points corresponding to the linear pattern in the next block of data from the display memory. Furthermore, the last address and the direction of the line determines the next block of data to be retrieved from the display memory.

In the manner described above, the present invention provides for high speed operation in a display controller. Other and more detailed aspects of the invention are discussed below.

DETAILED DESCRIPTION OF PREFERRED EMBODIMENTS

The present invention is especially adapted for the high speed processing of straight lines (vectors) so that most of the following description relates to vectors. Where curved lines (arcs) are processed, it is so noted.

Figure 2:
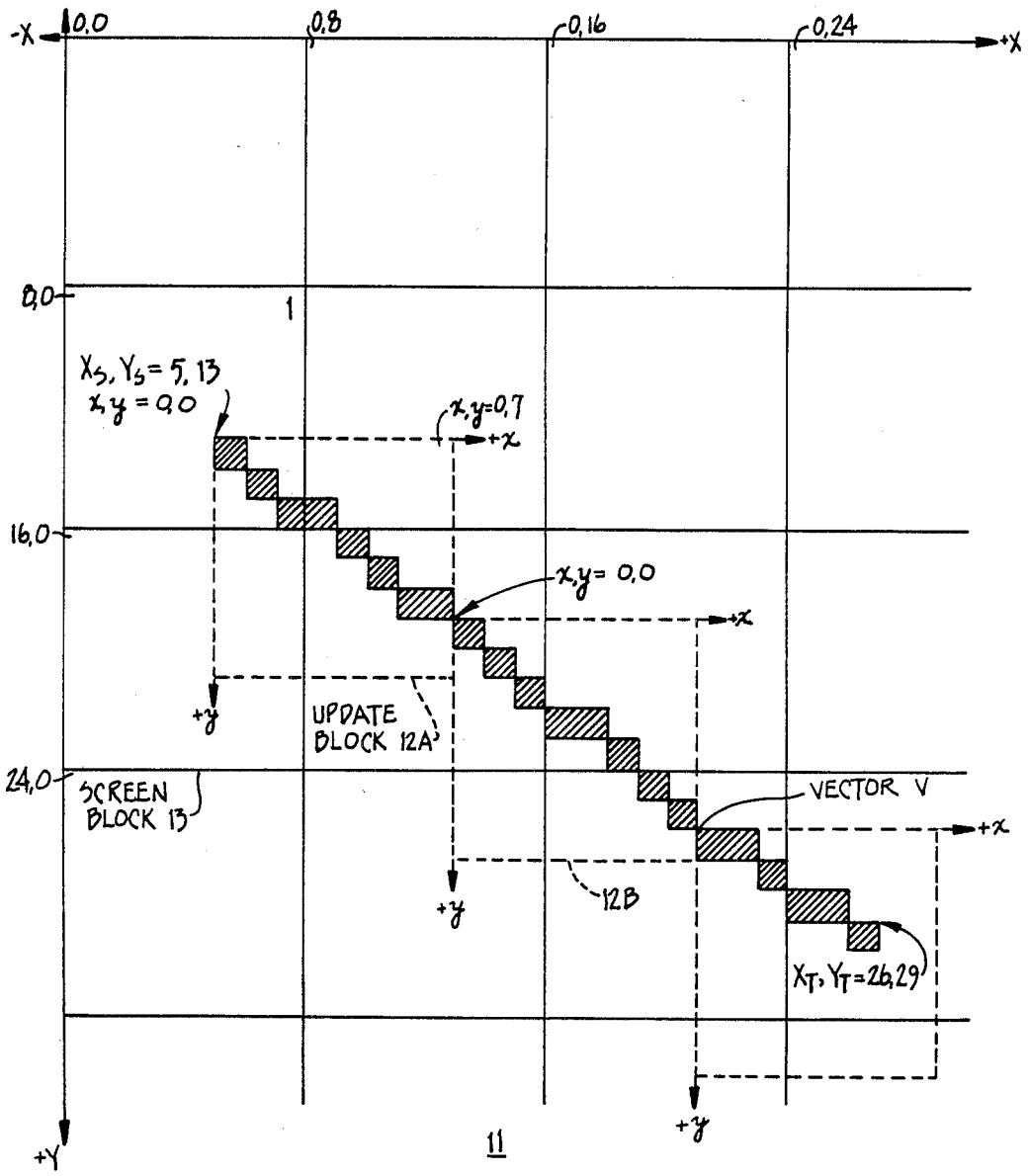
FIG. 2 shows a CRT display with a linear pattern V represented on it.

FIG. 2 is a representation of a straight line, termed a vector, as it might appear on a display device, such as a CRT. The solid vertical and horizontal lines which form a grid over the vector V represent the boundaries of the organization of the display memory 11, which is organized in an array fashion. Each area enclosed by the solid grid lines corresponds to an array of data. Each pixel, or data point, of the array, here shown as an $8\times8$ array, is stored in a different semiconductor RAM (Random Access Memory). (This is true for monochrome displays. For shaded or color displays, each pixel of the array is stored in a group of RAMs.) Thus, one of 64 RAMs is matched to a particular point in an array as well as to similarly located points in other similarly-aligned arrays. When all 64 RAMs are addressed simultaneously, 64 bits of data appear as output signals for an $8\times8$ array. The same 64 RAMs accessed simultaneously at a different address form the data array for another $8\times8$ array. The RAMs in this description, which have a capacity of 64K by 1, permit a display of arrays, each $8\times8$, of 256 arrays in the horizontal direction and 256 arrays in the vertical direction for a complete display on a device. Of course, this invention is not limited to the particular capacity of the RAMs comprising the display memory 11.

A linear pattern, such as vector V, can be located anywhere on the display as shown in FIG. 2. To write or remove vector V to and from the display memory, the present invention reads arrays of data which are indicated by the dotted lines. These arrays are selected to best cover the modifying linear pattern. For purposes of clarification, these data arrays are called "blocks" hereafter to distinguish them from the data organization of the display memory. Depending upon the location of a linear pattern, such as vector V, the blocks retrieved from the display memory 11 may or may not be congruent with any one of the arrays in the memory 11.

In FIG. 2, the vector V starts in the upper left-hand corner of the display with the display coordinates $(X_S, Y_S)=(5, 13)$ and extends in a rightward and downward direction to end at the display coordinates $(X_T, Y_T)=(26, 29)$.

As will be explained later in detail, the present invention reads from the display memory 11 a block 12A, which is demarcated by horizontal and vertical dotted lines. After the portion of vector V contained in the block 12A is, say, inserted into the data, the block 12A is returned to the display memory 11 and the next block 12B is read from the display memory 11 for modification to continue writing in the vector V. Finally, the block 12C is read from the display memory 11 and the last portion of the vector V including the terminal point $(X_T, Y_T)$ is written into the data and returned to the display memory 11.

Figure 1:
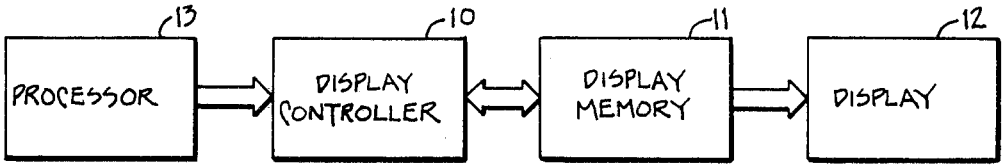
FIG. 1 illustrates a general configuration of a display system.
Figure 3:
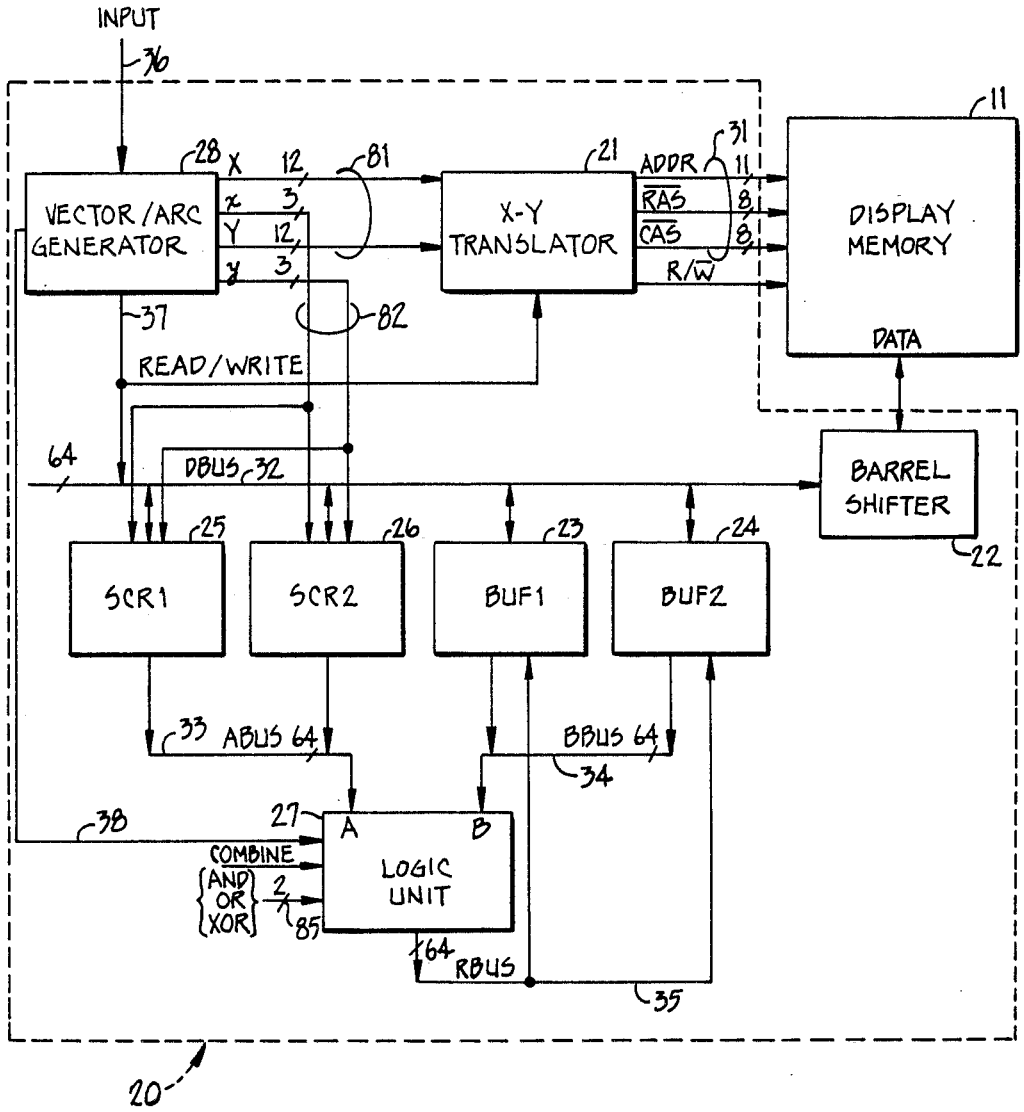
FIG. 3 illustrates an embodiment of the present invention in a block diagram form.

The present invention, which is part of the display controller 10 of FIG. 1, is shown in FIG. 3. The invention has an X-Y translator 21 which communicates to the display memory 11 through communication lines 31. The translator 21 generates the necessary addresses to the display memory 11 so that the data retrieved from or written into the display memory 11 are from or to the proper location. For example, in FIG. 2 the X-Y translator 21 generates the proper signals to the display memory 11 so that the block 12A is retrieved from the display memory 11. However, the block 12A is not located in a single array by which the display memory is organized. Rather, as is often the case, the block 12A occupies parts of four arrays. The X-Y translator 21 performs the addressing function to the display memory 11 so that the parts of the four arrays are properly retrieved.

Data to and from the display memory 11 is passed through a data bus 32 which is 64 lines wide to accommodate the data of an $8\times8$ block. By the nature of a display memory arranged in an array, the data to and from the display memory 11 must be passed through a two dimensional barrel shifter 22 to correct for the two dimensional rotation which occurs when data is written into or read from the array organized display memory 11. See FIG. 4 of the referenced paper by Gupta and Sproull above of an illustration of the two-dimensional rotation for data in array-organized memories. Thus, data from the display memory 11 is loaded into the buffer array 23 or 24 after passing through the barrel shifter 22 through the bus 32. Similarly, the data from any one of the buffer arrays 23, 24 pass through the barrel shifter 22 before being written into the display memory 11.

A vector/arc generator 28 receives input signals from the processor 13 of FIG. 1 along input lines 36. These signals tell the generator 28 what linear pattern function to perform and where the function is to be performed in the display memory 11. The generator 28 then sends the address of the linear pattern to the X-Y translator 21. These display coordinates are written as X and Y and the addresses of the upper lefthand corner pixel of each data block to be modified. These address signals are sent along a 24-bit wide data path 81 to the X-Y translator 21 which in turn generates the proper address signals and timing to the display memory 11 to form the data blocks from the arrays in the memory 11. As the display memory data is read through the barrel shifter 22 and into one of the buffer arrays 23, 24, the vector/arc generator 28 generates the memory locations of the vector in the data block in one of the buffer arrays 23, 24. These block addresses are indicated as x and y. The address signals are passed along a six-bit wide data path 82 to one of two scratch pad arrays 25, 26. These scratch pad arrays 25, 26 are each 64 flip-flops arranged in an $8\times8$ configuration corresponding to the organization of the buffer arrays 23, 24. Responsive to the address denoted by the signals on the lines 82, the flip flop at that address in a scratch pad array is set.

A logic unit 27 is connected to each of the buffer arrays 23, 24 by a B bus 34 and is connected to each of the scratch pad arrays 25, 26 by an A bus 33. Each of these buses 33, 34 are 64 lines wide. The logic unit 27 logically combines each of the datum stored in one of the buffer arrays 23, 24 with the corresponding datum stored in one of the scratch pad arrays 25, 26 for parallel operation. The logic unit 27 is responsive to control signals on control lines 85 which determine whether the logic unit 27 is to perform a logic AND, OR, XOR, INVERT-and-AND function useful in color transformation, or other functions with the A and B inputs to the logic unit 27. The combined result is then returned on a return bus 35 to one of the buffer arrays 23, 24. Like the preceding buses, the R bus 35 is 64 lines wide so all the combined data moves in parallel.

The different logic functions by the logic unit 27 permit a vector or arc to be written into the data block which will be transferred back into the display memory 11. The OR function allows the pattern generated by the generator 28 to be written into the data block. On the other hand, an XOR (exclusive OR) function for the logic unit 27 allows a pattern already in the display memory 11 to be removed by having the generator 28 generate the same pattern. The AND function allows the present invention to perform another type of operation with the vector or arc generated by the unit 28.

High speed operation occurs since the display memory data is moved and modified in parallel. The present invention also has the generator 28 generating its address signals (x,y) responsive to the input signals on the line 36 while data is transferred to the buffer arrays 23, 24 from the display memory 11.

Figure 4:
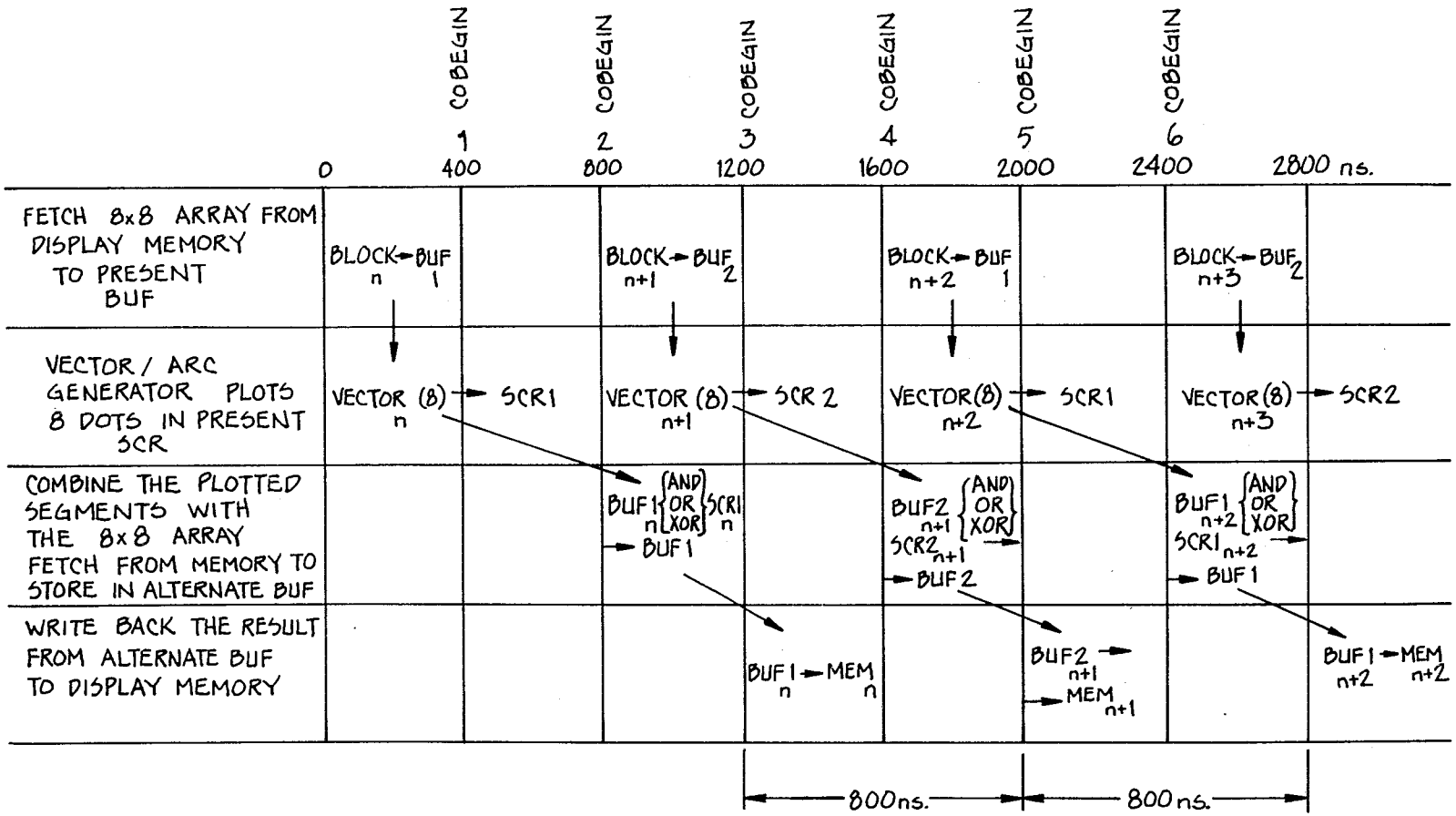
FIG. 4 is a timing chart of the operation of the present invention.

FIG. 4 illustrates the particular high speed operation of the present invention for straight lines or vectors. The present invention operates on a 50 nanosecond clock cycle. For a straight line to be combined into a data block n from the memory 11 takes only 800 nanoseconds. This is achieved by generating eight data point addresses of that part of the vector in the data block n as the block n is loaded into a buffer array 23, indicated as buffer 1 in FIG. 4 and termed the "present" buffer. The other buffer array 24 is then the "alternate" buffer. The addresses of the data points are transmitted to the scratch pad array 25, indicated as scratch array 1 and termed the "present" scratch pad array. The other scratch pad array 26 is the "alternate array".

It takes approximately 800 nanoseconds to move the block n into the buffer array 1 and the generator 28 generates each address within 100 nanoseconds. Thus, the contents of the buffer array 1 and the scratch pad array 1 are logically combined and loaded into the buffer array 1 after 800 nanoseconds.

At the same time, other operations start or COBEGIN. The next block n+1 in the display memory 11 is loaded into the buffer array 24 and designated as buffer 2 in FIG. 4. At this point the roles of the buffer arrays 23, 24 are switched so that the buffer array 24 becomes the present buffer and the buffer array 23 become the alternate buffer. Likewise, the roles of the scratch pad arrays 25, 26 are also switched. Correspondingly, the generator 28 generates the addresses for the next eight data points and sets the points in the scratch array 2.

At the 1200 nanosecond mark, the contents of the buffer array 1 the alternate buffer at this time is sent back to the display memory 11.

After 1600 nanoseconds, the roles of the buffer arrays 23, 24 again switch with the roles of the scratch pad arrays 25, 26. The third data block n+2 from the display memory is transferred into the present buffer array 1 while the addresses for the vector corresponding to data block is generated by the generator 28. Simultaneously, the contents of the buffer array 2, the second data block n+1, are logically combined with the contents of the alternate scratch array 2 and placed in the alternate buffer array 2. This alternation cycle continues until the complete vector is combined with the contents of the display memory. As may be seen in FIG. 4, each block of data from the display memory 11 is processed in 800 nanoseconds.

Figure 5:
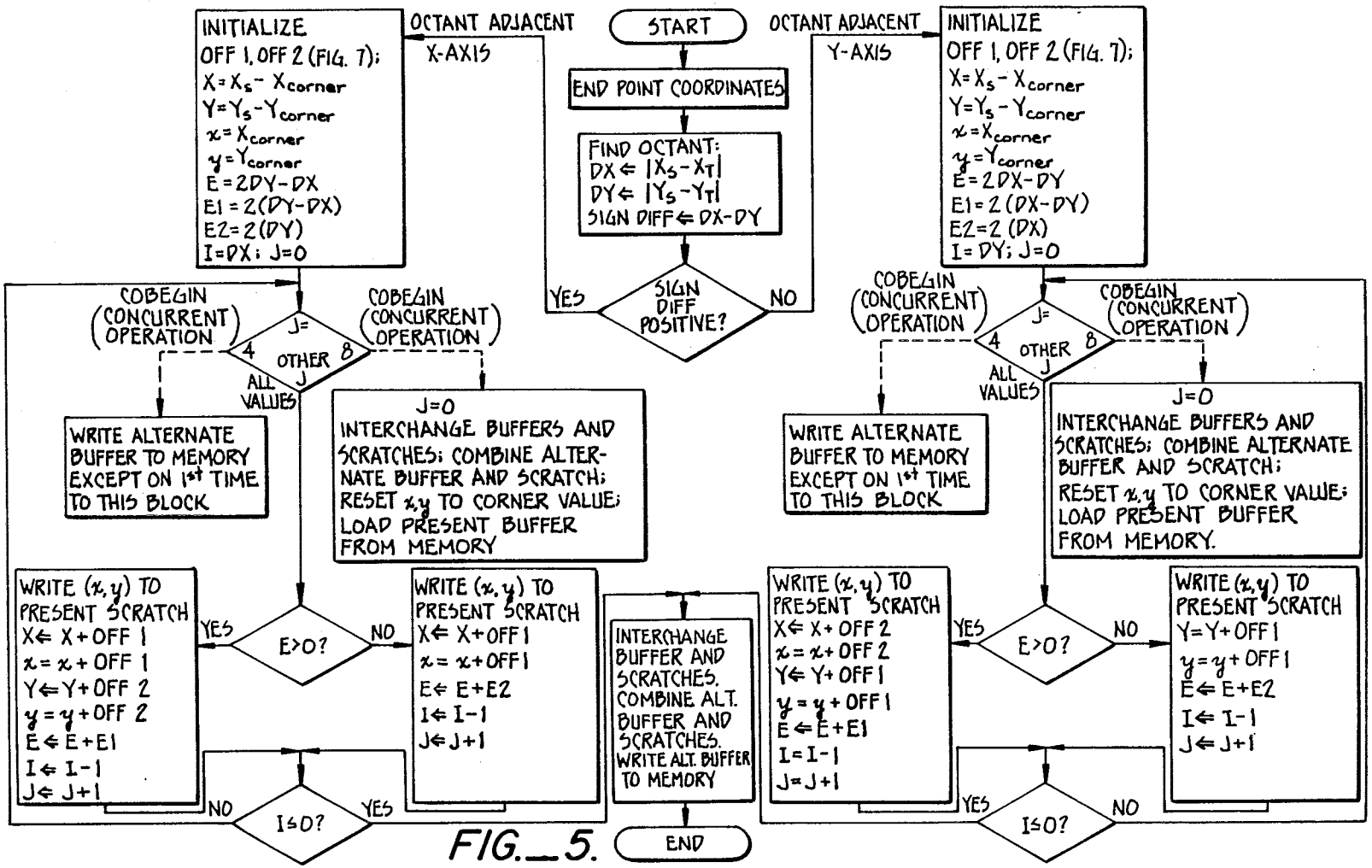
FIG. 5 is a flow chart of the interpolation operation of the vector generator in FIG. 3.

FIG. 5 illustrates the detailed steps by which the vector/arc generator 28 generates the block (x,y) addresses for a straight line to be communicated to the scratch pad arrays 25, 26 according to a modification of Breshenham's algorithm. By the nature of this algorithm, only eight points are generated for an 8×8 block, which maintains interpolation speed. Furthermore, the error is not cumulative, ensuring accuracy. The generator 28 also generates the display (X,Y) addresses and the vector direction, or octant, signals to the translator 25 to fetch the parts of the arrays stored in the display memory 11 to form the required data block.

Figures 6, 7:
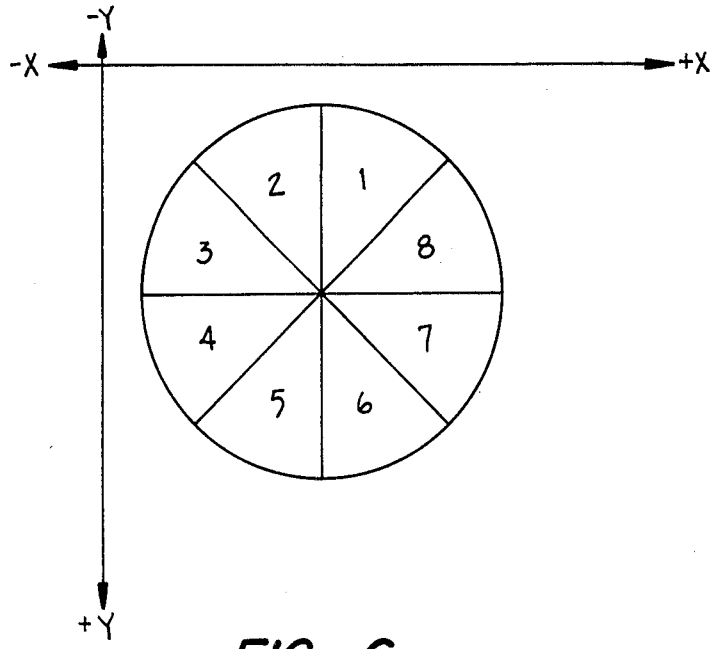
FIG. 6 shows the octant conventions used in the operation of the invention of FIG. 3.
FIG. 7 is a table of characteristics of vectors in each directional octant.

At the beginning of the generation process, the generator 28 receives the endpoint coordinates ($X_S$, $Y_S$,) and ($X_T$, $Y_T$) From these endpoint coordinates the direction of the straight line, or vector, from the beginning point to the endpoint is calculated. This is done by first calculating the absolute difference between the X coordinates (DX) and the absolute difference between the Y coordinates (DY). The sign of the difference between DX and DY, as well as the signs of the other two differences, indicate the particular octant for the vector to be calculated. FIG. 6 shows the spatial orientation of these octants to indicate the vector direction. It should be noted also that in forming these calculations, a positive X direction is to the right, while a positive Y direction is downward.

The coordinate axis on which the vector has the projection of greatest length is the "major" axis. The other axis is the minor axis. Hence if DX>DY, the major axis is X, and the minor axis is Y. If DY>DX, the major axis is Y and the minor axis is X. If DX=DY, either of the above assignments will work.

The interpolation steps shown in FIG. 5 follow separate paths depending upon which is the major axis. Since the vector follows the major axis more than the minor axis, there will be a "certain" offset OFF1 added to the coordinate of the major axis and a "possible" offset OFF2 may be added to the coordinate of the minor axis, in the calculation of the coordinates of the next data point after the current point. The offsets are each ±1, depending on the vector's direction, or octant which is fixed for a given vector. The interpolation is performed iteratively. At each iteration, if X is the major axis, certainly OFF1 and possibly OFF2 are added to X and Y (the display addresses), respectively, and to x and y (the data array address), respectively. The offsets are identical for X and x, and for Y and y. If Y is the major axis; certainly OFF1 and possibly OFF2 are added to Y and X (the display addresses), respectively, and to y and x (the data array addresses), respectively.

An example illustrates the calculation of the (X,Y) addresses and the (x,y) addresses. Referring back to vector V and FIG. 2, the endpoint coordinates ($X_S$, $Y_S$) equal (5,13) and the terminal point ($X_T$, $Y_T$) equal (26,29). DX equals 21 and DY equals 16. Taking the difference of DX and DY implies that the line from the beginning point ($X_S$, $Y_S$) is in octant 7. This matches the diagram shown in FIG. 6. Referring now to FIG. 7, it can be seen that the certain offset is +1 and the possible offset (offset 2) is also a +1. This makes sense since the major axis for a line in octant 7 is the X axis, i.e., the line is heading to the right and more toward the X axis than it is along the Y axis. Thus, OFF1 is a +1 which in this case is always added to X and x. Since the vector V in FIG. 2 is also headed downward, the possible OFF2 is also a +1, which in this case may possibly be added to Y and y. Note the convention that downward along the Y axis is positive.

Referring to FIG. 5, it can be seen that a determination that the vector V is in octant 7, or that the sign of (DX−DY) is positive, implies that the procedure in generating the addresses proceeds through the left branch of the flow chart. The registers for X and Y are loaded with the initial values $X_S$ and $Y_S$ minus the starting corner values in the table of FIG. 7, in this case (0,0). These values give the address of the upper lefthand corner pixel of the data block and are sent to the X-Y translator 21. Of course, the registers for x and y are initialized based upon the table of FIG. 7, in this case to (0,0).

The values for errors E, E1 and E2 are calculated. Ignoring the tests for the I and J counters, the procedure moves to testing the value of E. Since E equals 2DY−DX or 32−21=11, E is greater than 0. The coordinates for x,y are written to the present scratch pad arrays. The coordinates X,Y and x,y are updated. Since E was greater than 0, the next coordinate address proceeds at a 45° angle from the first coordinate. Both X (and x) and Y (and y) are incremented by 1. E is recalculated by adding E1 and the process returns for another test of the I and J counters. Again ignoring these tests, the test for the E value is performed. Since the value of E is equal to 1, which is greater than 0, both the X axis coordinates are incremented by offset 1. X equals 7; x equals 2. Likewise, the minor Y axis is also incremented by offset 2. Y equals 15; y equals 2. Recalculating (E=E+E1) yields −9. Thus on the next cycle of calculation only the major X axis is incremented and the Y axis is unchanged. X equals 8; x equals 3. Y equals 5; y equals 2. In this iterative manner, the coordinates X,Y and x,y are generated by the present invention.

From the last calculated coordinates in a block and octant of the vector, the first coordinates of the first point of the vector in the next data block can be determined without interruption of the interpolation process. The X, Y values of the first point continue from the first data block, while x, y coordinates are re-initialized to some corner point of the second data block. In the example of vector V of FIG. 2, the vector V has a direction indicated by octant 7. Thus, the initial x, y coordinates of each block of the vector V are 0, 0, the upper lefthand corner of block as indicted in FIG. 7.

Since the starting corner and its location is known, the location of the second data block from the display memory is also known.

The I and J counters keep track of the number of cycles used to perform the coordinate generation by the generator 28. The I counter at the initialization stage is set to be number of points separating the starting and terminal points along the major axis. This indicates the number of cycles required to generate the vector. In the example above, since DX is larger than DY, it is known that 22 cycles (DX+1) are required to generate the coordinates of vector V. Thus the I counter is loaded with the value 21. As each cycle is performed, the counter is decremented by 1 until I equals 0, at which point the interpolation process ends. The I counter test for completion is performed after (x,y) are written to a scratch pad register 25 or 26, which assures that the end point of the vector (the 22nd point in the example of FIG. 2) is plotted.

The J counter counts between 0 and 8. At the initialization step, J is set to 0 and at each pass through the cycle is incremented by 1. The J counter is used to start the COBEGIN operations. When J equals 4, or halfway into the complete 800-nanosecond cycle, the present invention loads the contents of the alternate buffer array into the display memory 11. The COBEGIN operation number 3 at the 1200 nanosecond mark in FIG. 4 illustrates this operation. At that point, the buffer array 1 which has the contents of the block n and loads the contents into the display memory 11. When the J counter is equal to 8, an 800 nanosecond cycle is complete, all 8 points for a data block being loaded into one of the two buffer arrays 23, 24 have been generated and a new generation of data points is started for the next data block. J is reset to 0 upon reaching the value 8.

As shown in the flow chart in FIG. 5, at that point the J register is reset to 0, the functions of the buffer and scratch arrays are interchanged. The present buffer array becomes the alternate buffer, while the alternate buffer becomes the present buffer array. A similar operation is performed to the scratch pad arrays. At the same time, the data contents of what is now the alternate buffer and scratch pad array are logically combined by the logic unit 27 and stored in the alternate buffer. This step is illustrated, for example, on the third row of operations shown in FIG. 4. Additionally, what is now the present buffer is loaded with the contents of a block from the display memory 11. Finally, the values of x and y are initialized back to the corner values from the table in FIG. 7 for the start of this new block.

The process continues until I is equal to or less than 0, at which point the vector instruction has been completely carried out. All that then remains is to merge and transmit the block just interpolated as output.

This method of calculating the X,Y addresses to the translator 25 and x,y addresses to the scratch pad array 25, 26 is an improvement of Breshenham's algorithm, which interpolates vectors at any angle. The improvement interpolates lines in two general cases—whether the X or Y is the major axis and the other the minor axis to permit a faster calculation of the X, x, Y and y coordinates.

Figure 8:
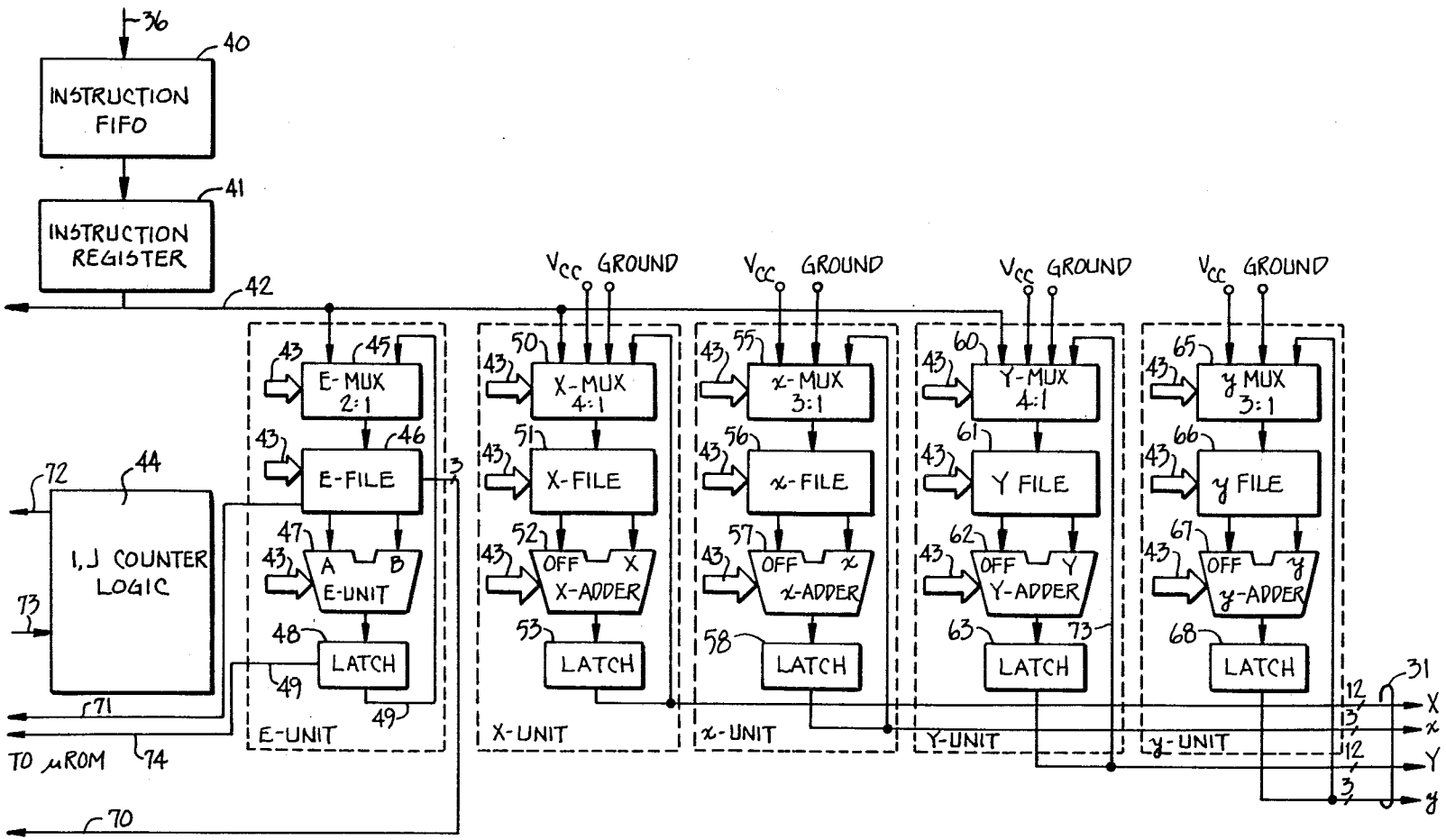
FIG. 8 is a schematic representation of the vector/arc generator of FIG. 3.
Figure 9:
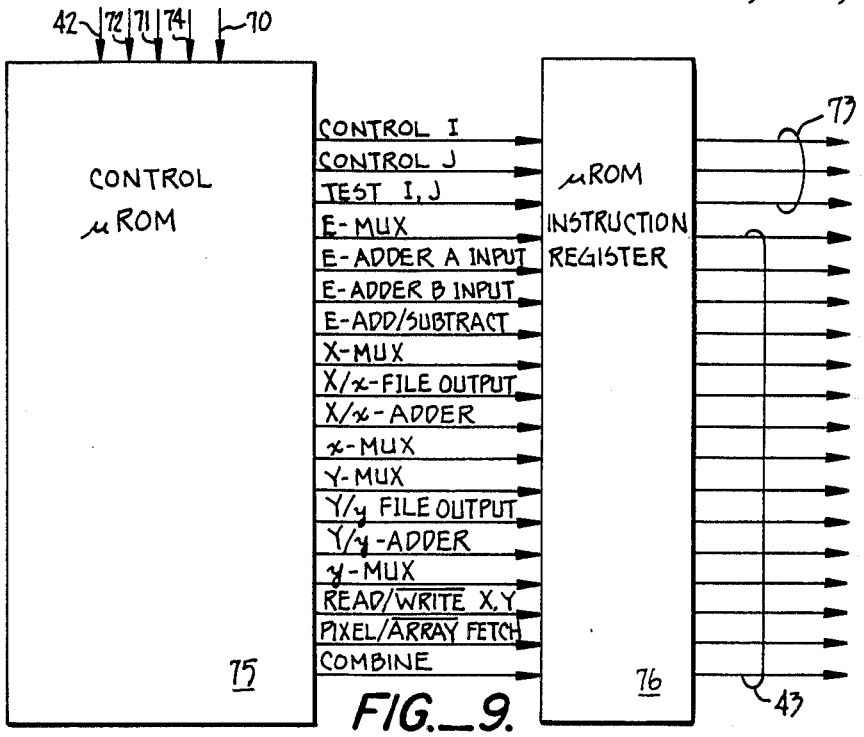
FIG. 9 is a representation of a μROM and control lines for controlling the operation of the vector/arc generator of FIG. 8.

FIG. 8 illustrates the details of the vector/arc generator 28. From the nature of the operation described previously, only simple calculating units, such as adders, are required. The generator 28 receives instructions from the processor 13 along input lines 36 to an instruction first-in first-out (FIFO) register 40. For the generation of a vector, such as vector V in FIG. 2, the instruction signals include a command to draw a vector, and the four $X_S$, $Y_S$, $X_T$ and $Y_T$ end point coordinates of the vector. From the instruction FIFO 40, the signals pass to an instruction register 41 which holds the signals for the processing parts of the generator 28. The instruction signals also go to a μROM, which controls the operation of the generator 28. These processing parts are divided into five units which respectively calculate the E value, and the calculation of the X, x, Y and y coordinate values. These units generally operate in parallel for high speed operation. The E unit has a multiplexer 45 which is coupled to the instruction register 41 through a line 42. The output of the multiplexer 45 is connected to a register file 46. The register file 46 has two outputs, A and B, which respectively are connected to the A and B inputs of an adder 47. The output of the adder 47 is fed into a latch 48 which output is fed back into the multiplexer 45 by a path 49.

The multiplexer 45, the file 46, and the adder 47 are all controlled by control lines, here denoted by reference numeral 43. The reference numeral 43 is used to indicate one or more control lines. The E-file 46 contains storage locations for the values of $X_S$, $X_T$, $Y_S$, $Y_T$, DX, DY, E, E1, E2, and the value of the octant calculated for the particular vector being processed. The values of DX, DY, E, E1, E2, and the octant are calculated by the E-unit. Thus, the E-unit calculates the E values for the modified Breshenham's algorithm process described above. The register files 51, 56, 61, 66 for X, x, Y, and y have a smaller number of storage spaces in their respective files. The X file 51, for example, contains the value for X, offset OFF1, and offset OFF2. The x-file 56 has storage places for the value of x, OFF1, and OFF2. The Y file 61 and the y file 66 have similar storage spaces for the OFF1 and OFF2 values and for Y and y, respectively.

The X unit and the Y unit also have their multiplexers 50, 60 connected to the instruction register 41 through the line 42. The x and y units do not. Instead, the multiplexers 56, 65 of these units are connected to voltage terminals $V_{cc}$ and ground. This is possible because the initial values of x and y will be either 0 or 7 in binary, which can be supplied by the terminals into the files for the x and y units. These terminals are also sufficient to supply the offset values for offset 1 and 2, which are restricted to $\pm 1$. Similar voltage terminals for the X file 51 and the Y file 61 are shown. These terminals also are used to set offset values and to initially calculate the $X_S$ minus $X_{corner}$, the block starting corner value in FIG. 7 (and $Y_S$ minus $Y_{corner}$).

The I, J Counter Logic Unit 44 keeps track of the I and J values as the generator 28 operates. The logic unit 44 communicates to a control μROM 75 through control lines 72, 73.

Also under the control of the μROM 75, the generator 28 operates to generate the values for X, x, Y and y coordinates for a data block. Such a μROM 75 and some of its control lines are labeled for exemplary purposes. Also shown are some of the control lines to the μROM 75, which include the instruction line 42, an E-line 71 from the file 46 to inform the μROM 75 of the polarity of the value of error E, line 74 with a similar function from the E unit latch 48 and the octant line 70.

It should be noted in passing that the μROM shown includes other units besides a ROM, such as a program counter, sequencers and other elements commonly found in a control unit.

Figure 10:
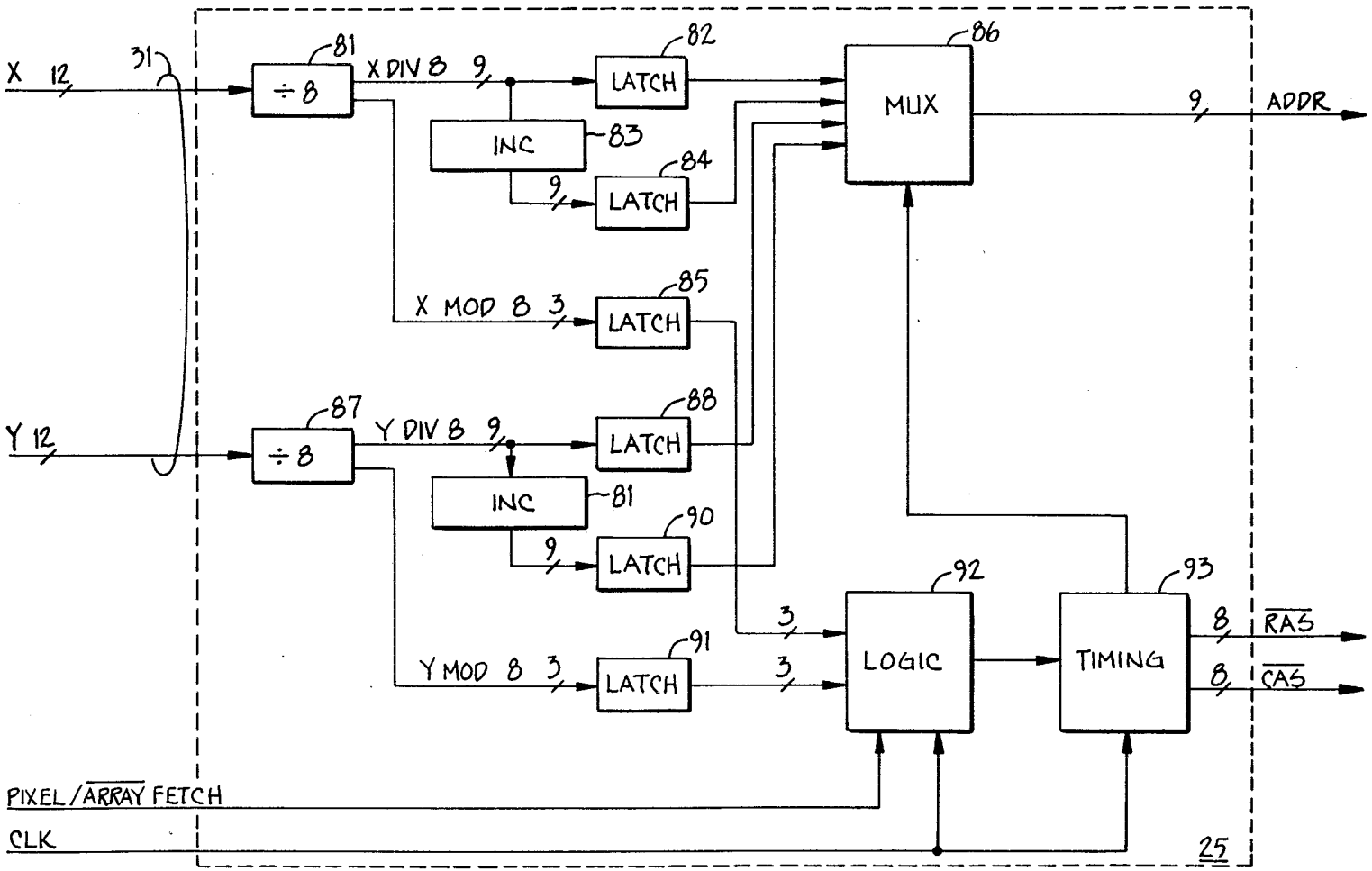
FIG. 10 is a schematic representation of the translator of FIG. 3.

The translator 21 is illustrated in FIG. 10. The X and Y values enter the translator 21 along lines 31. Each set of lines for the X value or the Y value is 12 bits wide. Only 11-bit wide lines are required for 64K capacity RAMs in the display memory 11. 12-bit wide lines permit 256K RAMs to be used for a higher resolution display memory. The translator 21 treats each value X and Y identically. The X value is divided by a divider 81 shifting the X value down by three places. The remaining data bits, the quotient or X div 8, are sent to a latch 82 and an incrementer 83. The result is stored in a latch 84. The remainder of the divider 81, X mod 8, is stored in a latch 85.

Similarly, the values of Y div 8, Y div 8 incremented or left the same, and Y mod 8 are respectively stored in latches 88, 90, and 91. The latches 82, 84, 88 and 90 are connected to the input terminals of a four-to-one multiplexer 86. The output of the multiplexer 86 appears on a 9 bit address line to the display memory 11. The latches 85, 91 are connected to a logic block 92, which is responsive to a clock signal and the control pixel/array fetch signal. The output of the logic block 92 is connected to the input of a timing block 93 which also receives a clock signal. The timing block 93 generates the signals for the 8-bit row address strobe ($\overline{RAS}$) lines and the 8 bit column address lines ($\overline{CAS}$). The lines are active low. The timing block 93 also is connected to the multiplexer 86 so that address signals are properly timed. Not shown is the fact that all of the latches 82, 84, 85, 88, 90 and 91 and the incrementers 83, 89 are also connected to clock signals for proper timing operation.

Figure 11:
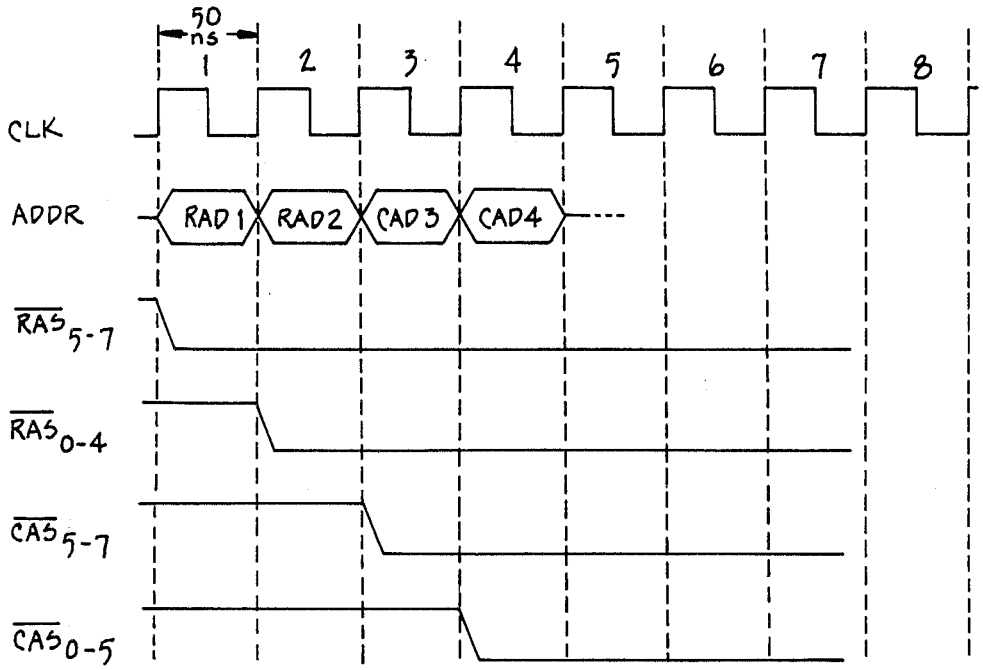
FIG. 11 is a diagram illustrating the timing of the translator of FIG. 10.

FIG. 11 illustrates the operation of the translator 21 through the example on FIG. 2. At the first 50 nanosecond clock cycle, the address line places the row address (RAD 1) of the two upper arrays through which the block 12A cuts through. At the same time, since the update block array 12A includes only the 5, 6 and 7 row lines of these arrays, the row address strobe for rows 5 through 7 ($\overline{RAS}$ 5–7) goes low to enable those chips within the array-organized display memory 11. At the second clock cycle, the row address (RAD 2) of the bottom two arrays in which the block 12A is located are placed on the address line of the translator 25. At this time the row address strobe lines for rows 0 through 4 ($\overline{RAS}$0 0–4) also go low to enable those RAMs in the semiconductor memory 11. The block 12A includes the 0 through 4 rows of the bottom arrays.

At this point, the semiconductor devices in the memory 11 have only their row addresses. At the third clock cycle the column address for the left two arrays (CAD 3) are placed on the address line by the translator 25. Correspondingly, the column address strobe lines for columns 5 through 7 ($\overline{CAS}$ 5–7) become enabled since those columns are included in the block 12A. At the fourth clock cycle the column addresses for the first five columns of the right two arrays (CAD 4) are placed on the address line and the column address strobe for lines 0 through 5 ($\overline{CAS}$ 0–4) become enabled.

Thus, after four 50 nanosecond clock cycles, all of the addresses are placed into the latches of semiconductor RAMs which comprise the display memory 11. From the nature of the operation of these integrated circuits having a certain data access and a certain amount of data settling time, the data appears approximately 350 nanoseconds from the display memory 11. As discussed previously, the data will appear rotated in two dimensions and must be shifted back through the barrel shifter 22 before being loaded into one of the buffer arrays 23, 24. This is performed within 800 nanoseconds.

The update blocks may not always include 4 arrays, but possibly two or even one array. The translator 21 performs its function in those cases. The above example was chosen only as the most complex case for its operation for illustrative purposes.

The present invention so far has dealt with the modification of blocks of data with straight lines, or vectors. For more complicated shapes, including curves or arcs, the present invention provides for the prior art point-by-point calculation and retrieval from display memory of datum comprising the complex shape. The pixel/array fetch control line in FIG. 10 permits the selection of operational modes, between array (or block) processing for vectors and single point processing for arcs.

However, by a suitable modification of Breshenham's algorithm for simple curves, many of the advantages of the present invention can be retained. These curves, such as those of a circle or ellipse, permit the interpolation of the arc by blocks rather than individual data points. Rather than octant directions, quadrant directions are used. The quadrant directions are not set as in the case of vectors, but are recalculated at the points where the curve begins to double back upon itself, either in the X-direction or the Y-direction. In the case of a circle, for instance, there are four such points, which are the extreme top, bottom, lefthand and righthand points of the circle.

This modification of Breshenham's algorithm and the calculation of quadrants minimizes processing time even if the interpolation of data points of the curve within a data block takes more time than for the transfer of the data block from the display memory. Curves generally require more calculation time than vectors and typically require more complex calculating units, such as multipliers, than shown in FIG. 8. However, since the data block can be transferred as the points are being interpolated, no time is wasted for data transfer.

Thus, while the invention has been particularly shown and described with reference to the preferred embodiments, it is understood by those skilled in the art that changes in form and details may be made therein without departing from the spirit of this invention. It is therefore intended that an exclusive right be granted to the invention as limited only by metes and bounds of the appendant claims.

What is claimed is:

1. A circuit for modifying data in a display memory organized in arrays of data for bit-mapped graphic display, comprising:

first memory means for receiving and holding a first block of data from said display memory;

a linear pattern generator, responsive to input signals, for generating signals corresponding to a selected linear pattern for said first block in approximately the same time as said first block is received by said first memory means;

second memory means for holding said generated signals from said linear pattern generator;

logic means for combining said first block and said second memory means signals into a modified first block for return to said display memory.

2. A circuit as in claim 1 further comprising:

third memory means for receiving and holding a second block of data from said display memory, said third memory means receiving said second block as said first block and said second memory means signals are combined; and fourth memory means for holding generated signals from said linear pattern generator, said generated signals corresponding to said selected linear pattern for said second block, said third memory means signal and said fourth memory means signals combined by said logic means into a modified second block for return to said display memory.

3. A circuit as in claim 2 wherein said first and second memory means alternately operate with said third and fourth memory means to modify arrays of data in said display memory.

4. The circuit of claim 1 wherein said vector generator comprises:

a first unit for calculating the ideal path of said line from the endpoint coordinates of said data point in said display;

a second unit for calculating the horizontal coordinate of said data point in said display;

a third unit for calculating the horizontal coordinate of said data point in said first block;

a fourth unit for calculating the vertical coordinate of said data point in said display; and a fifth unit for calculating the vertical coordinate of said data point in said first block.

5. The circuit as in claim 4 wherein first, second, third, fourth and fifth units, each comprise a multiplexer, a register file coupled to an output terminal of said multiplexer, an adder for arithmetically combining the contents of said register file, and a latch for holding the results of said adder.

6. A circuit for modifying data in a display memory organized in arrays of data for bit-mapped graphics, comprising:

a first pair of memory means, each coupled to said display memory for receiving and holding blocks of bits from said display memory;

a vector generator, responsive to instruction signals, for generating signals corresponding to a selected vector;

a second pair of memory means, each coupled to said pattern generator, for receiving and holding said pattern generator signals; and logic means, coupled to each of said first and second pair of memory means, for logically combining a first block of data in one of said first memory pair and said pattern generator signals in one of said second memory pair, whereby said block of data is modified in accordance to said instruction signals.

7. A circuit as in claim 6 wherein a second block of data is transferred from said display memory into the other of said first memory pair as said first block and said pattern generator signals in said one of said second memory pair are logically combined.

8. A circuit as in claim 7 wherein said vector generator generates signals corresponding to said selected vector for said second block as said second block is transferred into said other of said first memory pair, said generated signals for said second block received and held by the other of said second memory pair.

9. A circuit as in claim 8 wherein said one of said first memory pair alternates in operation with said other of said first memory pair for modification to a plurality of blocks.

10. A circuit as in claim 9 wherein said vector generator generates signals for an block in approximately the same time as said block is transferred into one of said first memory pair.

11. A circuit as in claim 6 further comprising a barrel shifter coupled to said display memory and said first memory pair, said barrel shifter capable of shifting data from said display and said first memory pair in two dimensions whereby rotation of said data after transfer is prevented.

12. A circuit as in claim 6 wherein said logic means is capable of ANDing, ORing and XORing said first block of data and said line pattern generator signals responsive to control signals.

13. A circuit as in claim 6 wherein said first memory pair is coupled to said display memory by a first bus having a line corresponding to each datum of an block in said display memory so that data is transmitted between said first memory pair and said display memory in parallel.

14. A circuit as in claim 13 wherein said second memory pair is coupled to said vector generator by a second bus, each of said second memory pair capable of holding a block of data corresponding to an block in said display memory, said second bus having a number of lines so that each datum held in said second memory pair may be addressed.

15. A circuit as in claim 14 wherein said first memory pair and said second memory pair are coupled to said logic means by third and fourth buses, each having the same number of lines as said first bus so that data from said first memory means and data from second memory means are transmitted in parallel to said logic means.

16. A circuit as in claim 14 wherein said vector generates address signals from said instruction signals to set each addressed datum in one of said second memory pair.

17. The method of modifying an array-organized display memory with a linear pattern in a display memory coupled controller having a first pair of memory means and a second pair of memory means comprising:

retrieving a first block of data from said display memory to a first of said first memory pair;

interpolating a first set of data points approximating a vector in said first data block as said first data block is retrieved; and combining said first set of data points contained in said first of said second memory pair with the first data block in said first of said first memory pair to obtain a modified first block.

18. The method of claim 17 further comprising determining the next block of data for retrieval from said display memory from the last point interpolated for said first data block and the direction of said pattern.

19. The method of claim 18 further comprising repeating the above steps until all data points necessary to approximate the line have been interpolated.

20. The method of claim 19 wherein said pattern is a vector and the direction is determined by calculating the octant in which said vector lies from its starting point.

21. The method of claim 19 wherein said pattern is a simple curve and the direction of a point on said curve is determined by calculating the quadrant in which said curve lies from said point.

22. The method of claim 17 wherein said data points are interpolated by a modification of Breshenham's algorithm.

23. The method of claim 22 wherein said interpolation step for a set of data points for data block is performed in substantially the same time as said data block retrieval step is performed.

* * * * *